US009478893B2

(12) United States Patent
Endo et al.

(10) Patent No.: US 9,478,893 B2
(45) **Date of Patent: *Oct. 25, 2016**

(54) ELECTRIC CONNECTOR

(71) Applicant: DAI-ICHI SEIKO CO., LTD., Kyoto (JP)

(72) Inventors: Takayoshi Endo, Shizuoka (JP); Sakai Yagi, Shizuoka (JP); Shuji Touno, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 165 days.

This patent is subject to a terminal disclaimer.

(21) Appl. No.: 14/293,200

(22) Filed: Jun. 2, 2014

(65) Prior Publication Data

US 2014/0370755 A1 Dec. 18, 2014

(30) Foreign Application Priority Data

Jun. 14, 2013 (JP) ..... 2013-125488

(51) Int. Cl.

| | |
|---|---|
| ***H01R 13/50*** | (2006.01) |
| ***H01R 43/18*** | (2006.01) |
| ***H01R 43/24*** | (2006.01) |
| ***H01R 43/00*** | (2006.01) |
| *H01R 13/52* | (2006.01) |

(52) U.S. Cl.

CPC ..... *H01R 13/50* (2013.01); *H01R 43/005* (2013.01); *H01R 43/18* (2013.01); *H01R 43/24* (2013.01); *H01R 13/521* (2013.01); *H01R 13/5216* (2013.01); *Y10T 29/49208* (2015.01); *Y10T 29/53209* (2015.01)

(58) Field of Classification Search

CPC ..... H01R 9/00; H01R 13/405; H01R 43/005

See application file for complete search history.

(56) References Cited

U.S. PATENT DOCUMENTS

| | | | |
|---|---|---|---|
| 2011/0034089 | A1 | 2/2011 | Nagashima |
| 2013/0149905 | A1 | 6/2013 | Endo et al. |

FOREIGN PATENT DOCUMENTS

| | | |
|---|---|---|
| JP | 6-208863 | 7/1994 |
| JP | 2002-231405 | 8/2002 |
| JP | 2011-44253 | 3/2011 |

OTHER PUBLICATIONS

European Search Report issued Aug. 29, 2014 in corresponding European patent application No. EP 14 17 1079.

*Primary Examiner* — Briggitte R Hammond
(74) *Attorney, Agent, or Firm* — Wenderoth, Lind & Ponack, L.L.P.

(57) ABSTRACT

An electric connector includes a housing having an opening and a bottom, the housing being formed at the bottom with a recess, a terminal inserted into the housing through a bottom of the recess such that a top thereof is located in the housing, and a cured resin filled in the recess, the recess having an inclining inner sidewall.

8 Claims, 17 Drawing Sheets

ELECTRIC CONNECTOR

FIELD OF THE INVENTION

The invention relates to an electric connector including a housing composed of an electrically insulative material, and a terminal inserted in the housing. The invention relates further to a housing suitable for the electric connector, a method of fabricating the electric connector, and a dispenser suitable to the electric connector.

DESCRIPTION OF THE RELATED ART

FIG. 12 is a plan view of a conventional electric connector 80, and FIG. 13 is a cross-sectional view taken along the line E-E shown in FIG. 12.

The illustrated electric connector 80 includes a box type housing 81 having an opening 81*a*, a plurality of terminals 82 inserted into the housing 81 through a bottom 81*b* of the housing 81 such that tops 82*a* thereof protrude in the housing 81, a recess 83 formed at the bottom 81*b* of the housing 81 around the terminals 82 so as to be recessed below an upper surface 81*c* of the bottom 81*b*, and a potting resin 84 filled and cured in the recess 83.

In the electric connector 80 illustrated in FIGS. 12 and 13, the potting resin 84 is filled in the recess 83 in accordance with the steps illustrated in FIGS. 14 to 17.

First, as illustrated in FIGS. 14 and 15, a dispenser 90 is inserted at a top 92 of a discharge tube 91 thereof into the recess 83 through the opening 81*a* of the housing 81. Then, as illustrated in FIG. 16, an uncured potting resin 84*a* in the form of a viscous fluid is poured into the recess 83 through a discharge port 93 of the discharge tube 91.

After the recess 83 was filled with the potting resin 84*a*, the dispenser 90 is moved away from the housing 81, and the potting resin 84 filling the recess 83 therewith is caused to be cured. Thus, the recess 83 is filled with the solidified potting resin 84.

Japanese Patent Application Publication No. 2011-44253 has suggested a connector 100 illustrated in FIG. 18.

The illustrated connector 100 includes a connector housing 110 having a hood 111 and composed of synthetic resin, and a terminal 120 having a tub 121 protruding into the hood 111 through a bottom of the hood 111. The connector housing 110 is formed at a bottom thereof with a recess 112. The recess 112 is filled with a resin 113.

In the connector 100, the recess 112 is designed to have an inner sidewall 112A inclining by about 5 to about 10 degrees, in order to make it easy to remove the connector housing out of a die after the connector housing was molded.

Furthermore, the recess 112 is designed to be cone-shaped or to have a wide opening in order to ensure a wide space for insertion of a nozzle through which a potting resin is poured into the recess 112.

When the uncured potting resin 84*a* is poured into the recess 83 in the steps of fabricating the electric connector 80, it is necessary to avoid generation of bubbles in the uncured potting resin 84*a*. Thus, as illustrated in FIG. 14, a discharge port 93 of a discharge tube 91 of the dispenser 90 is set located in the vicinity of an inner bottom 83*a* (for instance, a distance between the inner bottom 83*a* and the discharge port 93 is about 0.5 mm), and then, the uncured potting resin 84*a* is poured into the recess 83.

However, after a requite volume of the uncured potting resin 84*a* was filled in the recess 83 in the above-mentioned condition (for instance, after the uncured potting resin 84*a* was filled in the recess 83 at a height in the range of about 2 to about 5 mm above the inner bottom 83*a*, the discharge port 93 of the discharge tube 91 sinks in the uncured potting resin 84*a*, as illustrated in FIG. 16.

Consequently, when the discharge tube 91 is pulled up out of the uncured potting resin 84*a* after the recess 83 was filled with the uncured potting resin 84*a*, a portion of the uncured potting resin 84*a* surrounding the discharge tube 91 flows into an area where the discharge tube 91 used to be located, and thus, the uncured potting resin 84*a* is stirred, resulting in generation of bubbles in the uncured potting resin 84*a*.

Furthermore, when the discharge tube 91 is pulled up out of the uncured potting resin 84*a* after the recess 83 was filled with the uncured potting resin 84*a*, a portion of the uncured potting resin 84*a* adhered to the discharge tube 91 falls into the uncured potting resin 84*a* existing in the recess 83, resulting in generation of bubbles in the uncured potting resin 84*a* existing in the recess 83.

In order to avoid the problem as mentioned above, as illustrated in FIG. 15, the discharge port 93 of the discharge tube 91 is set located relatively high in the recess 83 (for instance, the discharge port 93 is located at a height of 3 mm or higher from the inner bottom 83*a*), and then, the uncured potting resin 84*a* is poured into the recess 83 through the discharge port 93.

However, if the discharge port 93 is set located in the manner as illustrated in FIG. 15, since the discharge port 93 of the discharge tube 91 is located relatively much away from the inner bottom 83*a* of the recess 83, the uncured potting resin 84*a* having been poured into the recess 83 from the discharge port 93 makes collision with the inner bottom 83*a*, and resultingly, is dispersed to involve air therein. Thus, it is not avoidable to allow a lot of bubbles 85 to be generated in the uncured potting resin 84*a* existing in the recess 83.

As illustrated in FIG. 13, a majority of the bubbles 85 generated in the uncured potting resin 84*a* while the recess 83 is being filled with the uncured potting resin 84*a* remain in the cured potting resin 84, resulting in the deterioration in the sealing performance of the cured potting resin 84. In particular, in the case that the cured potting resin 84 is designed thin, a plurality of the bubbles 85 remaining the cured potting resin 84 links with one another, resulting in the remarkable deterioration in the sealing performance of the cured potting resin 84.

In the above-mentioned Japanese Patent Application Publication, the recess 112 formed at a bottom of the connector housing 110 is designed to include the inner sidewall 112A inclining by about 5 to about 10 degrees. The reason why the inner sidewall 112A is inclined is merely to make it easy to remove the connector housing 110 out of a die after the connector housing 110 was molded in the die. The recess 112 has no function of avoiding the generation of bubbles when the potting resin 113 is poured into the recess 112.

The recess 112 disclosed in the above-mentioned Japanese Patent Application Publication is designed to be cone-shaped to have a wide opening. This is because a wide space is ensured for a discharge nozzle when the potting resin 113 is poured into the recess 112 through the discharge nozzle. Thus, the recess 112 has no function of avoiding the generation of bubbles in the cured potting resin 113 when the uncured potting resin 113 is poured into the recess 112.

Furthermore, the above-mentioned Japanese Patent Application Publication fails to suggest not only the problem of the generation of bubbles while the uncured potting resin 113 is being poured into the recess 112, but also the possibility of the generation of bubbles while the uncured potting resin 113 is being poured into the recess 112.

SUMMARY OF THE INVENTION

In view of the above-mentioned problems in the conventional connectors, it is an object of the present invention to provide an electric connector capable of avoiding the generation of bubbles in the resin while the recess is being filled with the uncured resin to thereby provide excellent sealing performance of the potting resin. It is further an object of the present invention to provide a connector housing, a method of fabricating an electric connector, and a dispenser used for the electric connector all of which are capable of doing the same.

In one aspect of the present invention, there is provided an electric connector including a housing having an opening and a bottom, the housing being formed at the bottom with a recess, at least one terminal inserted into the housing through a bottom of the recess such that a top thereof is located in the housing, and a cured resin filled in the recess, the recess having an inclining inner sidewall.

The electric connector in accordance with the present invention makes it possible to pour an uncured resin towards the inclining inner sidewall through a discharge port of a dispenser. The inclining inner sidewall allows the uncured resin to downwardly flow therealong. Accordingly, the uncured resin can smoothly flow along the inner sidewall downwardly without rebounding and dispersing to thereby fill the recess therewith. Thus, the generation of bubbles can be avoided while the recess is being filled with the uncured resin, ensuring superior sealing performance of the cured resin.

It is preferable that the inner sidewall inclines at an angle in the range of 25 to 50 degrees both inclusive. Herein, the inclination angle indicates an acute angle formed between a vertical imaginary line and the inclining inner sidewall.

The inclining inner sidewall allows an uncured resin to smoothly flow therealong, ensuring that the generation of bubbles can be avoided while the recess is being filled with an uncured resin.

As an alternative, the inner sidewall may be designed to downwardly project in an arcuate form.

It is preferable that a horizontal length of the inner sidewall is greater than a diameter of a discharge port of a dispenser by which an uncured resin is poured into the recess. Herein, the horizontal length indicates a distance upper and lower edges of the inclining inner sidewall projected onto an imaginary horizontal plane perpendicular to a vertical imaginary line.

By so setting the horizontal length, an uncured resin vertically falls at an entirety thereof from a discharge port of a dispenser onto the inclining inner sidewall, and thereby smoothly flows on the inclining inner sidewall, avoiding the generation of bubbles while the recess is being filled with an uncured resin.

In another aspect of the present invention, there is provided a connector housing having an opening and a bottom, the connector housing being formed at the bottom with a recess, and further formed at a bottom of the recess with at least one through-hole through which a terminal is inserted into the connector housing, the recess having an inclining inner sidewall.

In the connector housing, it is preferable that the inner sidewall inclines by 25 to 50 degrees both inclusive.

In the connector housing, it is preferable that the inner sidewall downwardly directs in an arcuate form.

In the connector housing, it is preferable that a horizontal length of the inner sidewall is greater than a diameter of a discharge port of a dispenser by which an uncured resin is poured into the recess.

In still another aspect of the present invention, there is provided a method of fabricating an electric connector, including preparing a housing used for an electric connector, the housing having an opening and a bottom, the housing being formed at the bottom with a recess, and further formed at a bottom of the recess with at least one through-hole through which a terminal is inserted into the housing, the recess having an inclining inner sidewall, inserting a terminal through the through-hole such that a top of the terminal is located in the housing, locating a discharge port of a dispenser above the inner sidewall, the discharge port having a diameter smaller than a horizontal length of the inclining inner sidewall, discharging an uncured resin onto the inclining inner sidewall through the discharge port to fill the recess with the uncured resin, and curing the uncured resin.

It is preferable that the method further includes horizontally moving the dispenser along the inclining inner sidewall.

In yet another aspect of the present invention, there is provided a dispenser to be used for the above-mentioned connector housing formed with a recess having an inclining inner sidewall, the dispenser having a discharge port having a diameter smaller than a horizontal length of the inclining inner sidewall, the discharge port inclining at the same degree as that of the inclining inner sidewall.

In still yet another embodiment, there is provided a dispenser to be used for the above-mentioned connector housing formed with a recess having an arcuate inner sidewall, the dispenser having a discharge port having a diameter smaller than a horizontal length of the inclining inner sidewall, the discharge port having the same curvature as that of the inner sidewall.

The advantages obtained by the aforementioned present invention will be described hereinbelow.

The electric connector in accordance with the present invention is capable of avoiding bubbles from being generated while a recess is being filled with an uncured resin, to thereby ensure the excellent sealing performance of a cured resin. The connector housing, the method of fabricating an electric connector, and the dispenser all in accordance with the present invention are capable of doing the same.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

An electric connector 10 in accordance with the first embodiment of the present invention is explained hereinbelow with reference to FIGS. 1 to 7.

Figure 1:
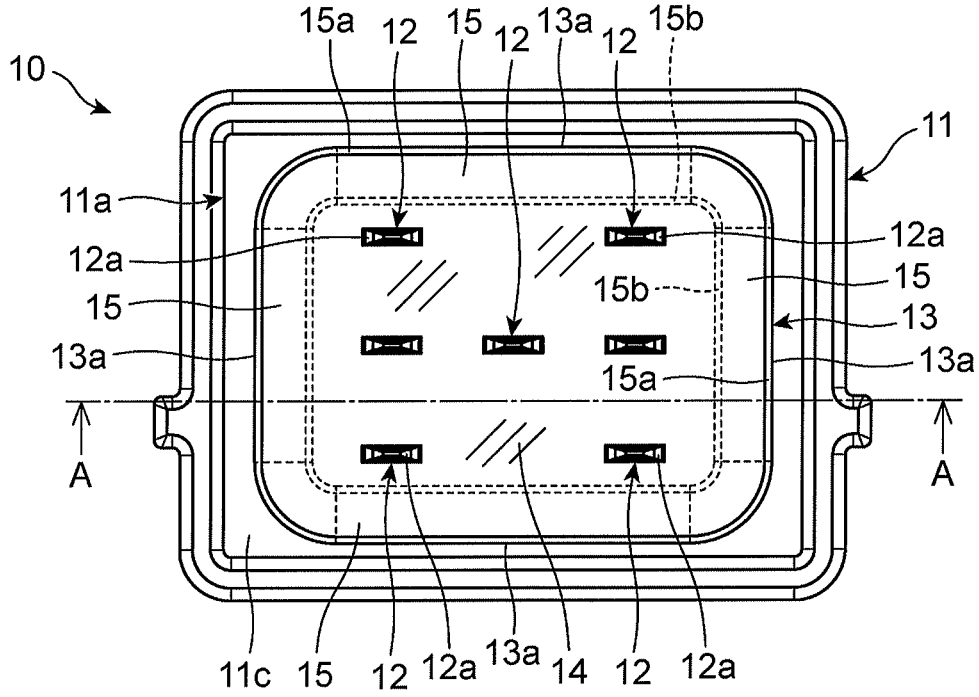
FIG. 1 is a plan view of the electric connector in accordance with the preferred embodiment of the present invention.
Figure 2:
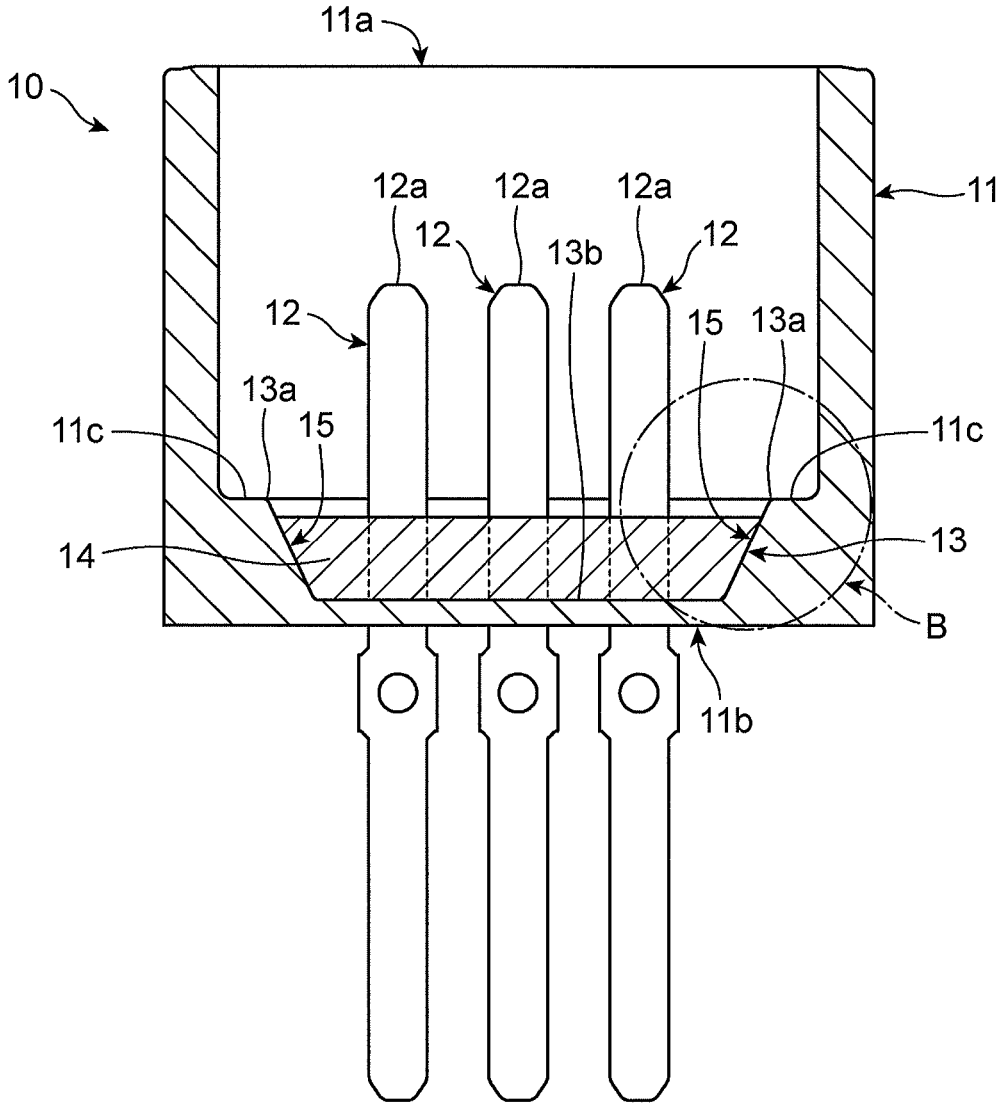
FIG. 2 is a cross-sectional view taken along the line A-A shown in FIG. 1.
Figure 3:
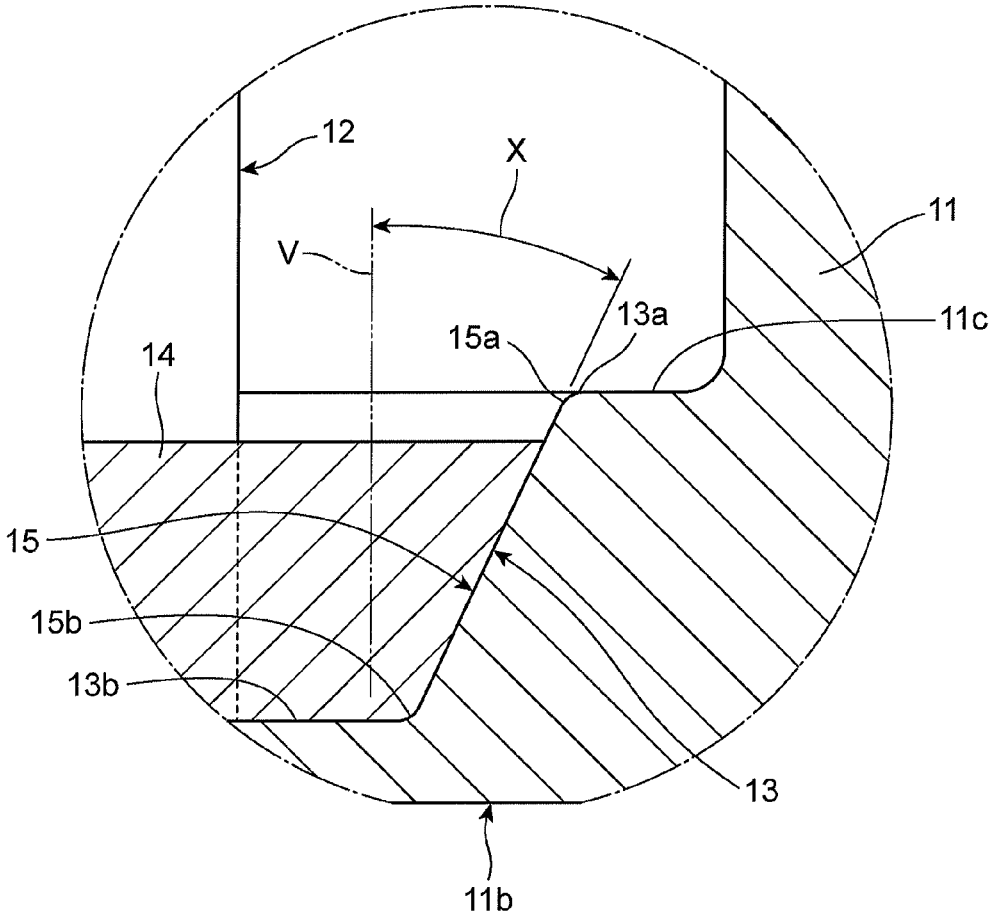
FIG. 3 is an enlarged view of an area indicated with an arrow B shown in FIG. 2.

As illustrated in FIGS. 1 to 3, the electric connector 10 includes a box-type housing 11 being composed of an electrically insulating resin and having an opening 11*a*, and further being formed at a bottom 11*c* thereof with a recess 13 having an inner bottom 13*b*, a plurality of terminals 12 inserted into the housing 11 through through-holes formed through the inner bottom 13*b* of the recess 13 such that tops 12*a* thereof protrude into the housing 11, and a potting resin 14 filling the recess 13 therewith and being cured. The recess 13 is designed to have an inclining inner sidewall 15. Specifically, the inner sidewall 15 downwardly inclines from an upper edge 13*a* of the recess 13 towards the inner bottom 13*b*. As mentioned later, the inclining inner sidewall 15 smoothly introduces an uncured resin into the recess 13.

As illustrated in FIG. 3, an inclination angle X of the inner sidewall 15 is set to be 25 degrees. However, it should be noted that the inclination angle X is not to be limited to 25 degrees, but may be varied in the range of 25 to 50 degrees both inclusive. Herein, the inclination angle X by which the inner sidewall 15 inclines is defined as an acute angle formed between a vertical imaginary line V and the inner sidewall 15 when an uncured resin is poured into the recess 13 of the housing 11.

As illustrated in later-mentioned FIG. 6, a horizontal distance S between an upper edge 15*a* and a lower edge 15*b* of the inner sidewall 15 is set greater than a diameter 32*a* of a discharge port 32 of a discharge tube 31 in a dispenser 30 through which an uncured potting resin 14*a* is poured into the recess 13. Herein, the horizontal distance S is defined as a distance between the upper edge 15*a* and the lower edge 15*b* of the inner sidewall 15 projected onto an imaginary horizontal plane H perpendicular to the vertical imaginary line V. In the first embodiment, the upper edge 15*a* of the inner sidewall 15 is located slightly below the upper edge 13*a* of the recess 13.

In the electric connector 10 in accordance with the first embodiment, the uncured potting resin 14*a* is poured into the recess 13 in accordance with steps illustrated in FIGS. 4 to 7.

Figure 5:
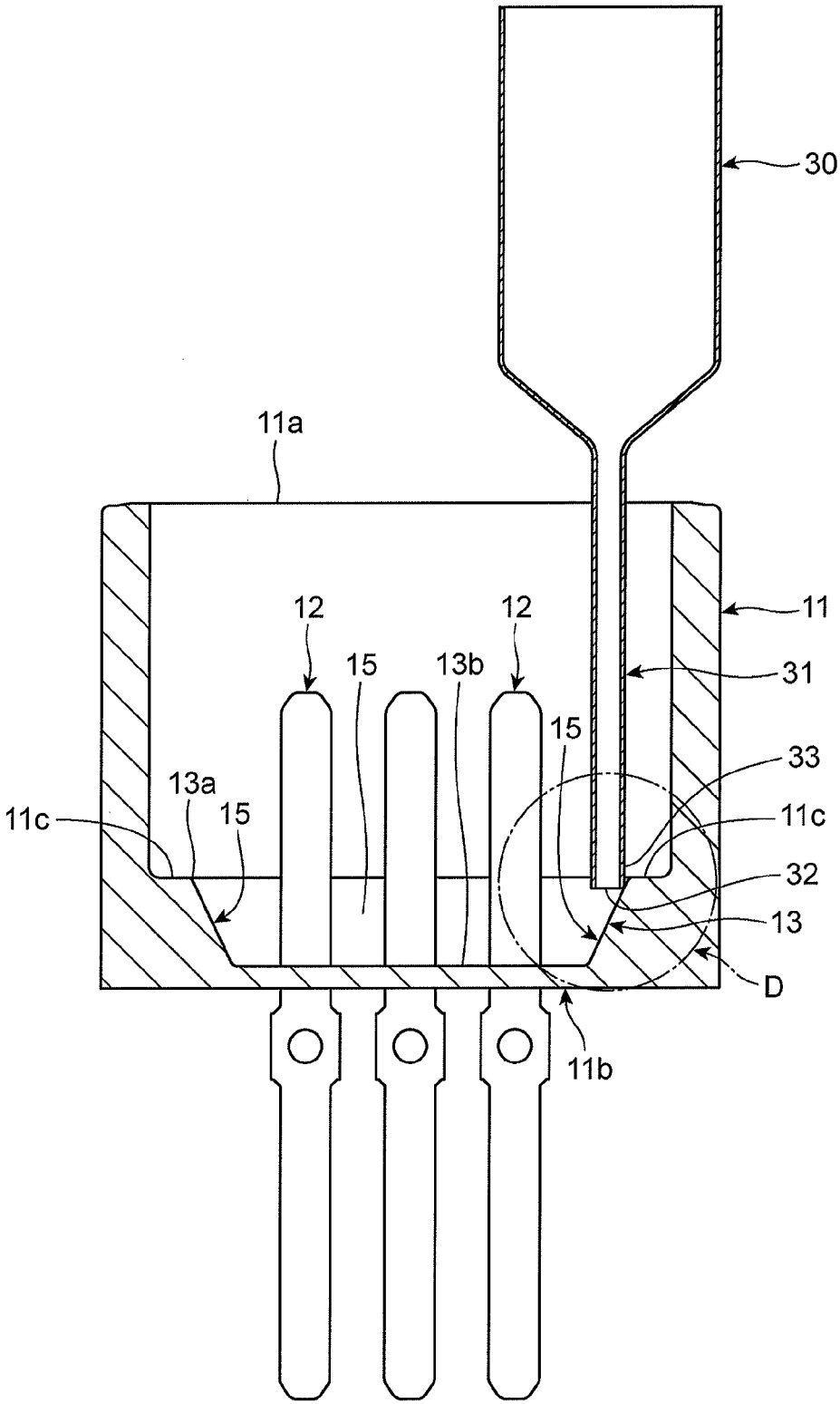
FIG. 5 is a cross-sectional view taken along the line C-C shown in FIG. 4.

In order to pour the uncured potting resin 14*a* into the recess 13, there is used a dispenser 30 illustrated in FIG. 5. The dispenser 30 includes a discharge tube 31 having a top end portion 33, and a discharge port 32 at an end of the top end portion 33.

Figure 4:
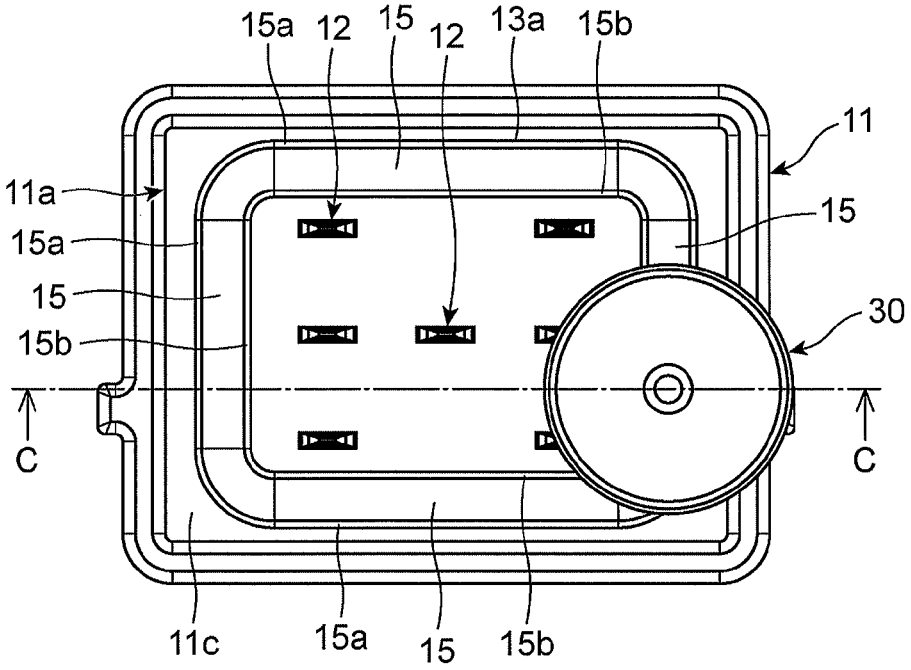
FIG. 4 is a plan view of the electric connector illustrated in FIG. 1 together with a dispenser used for pouring a resin into the electric connector.
Figure 7:
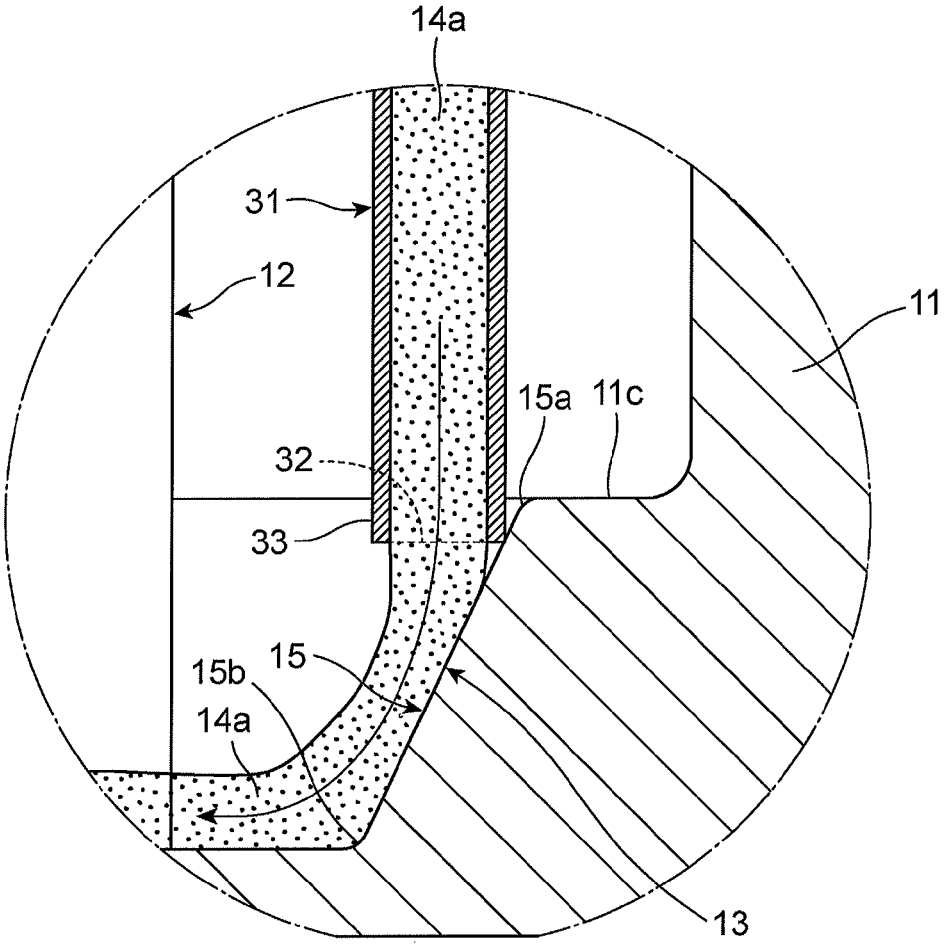
FIG. 7 is a partially enlarged cross-sectional view of the electric connector illustrated in FIG. 5 into which a resin is poured through a dispenser.

First, as illustrated in FIGS. 4 and 5, the dispenser 30 is inserted into the housing 11 through the opening 11*a*, and the top end 33 is kept partially in contact with the inclining inner sidewall 15. Then, as illustrated in FIG. 7, the uncured potting resin 14*a* in the form of viscous fluid starts to be poured into the recess through the discharge port 32 of the discharge tube 31. The dispenser 30 is caused to horizontally move along the inclining inner sidewall 15 during pouring the uncured potting resin 14*a* into the recess 13.

Figure 8:
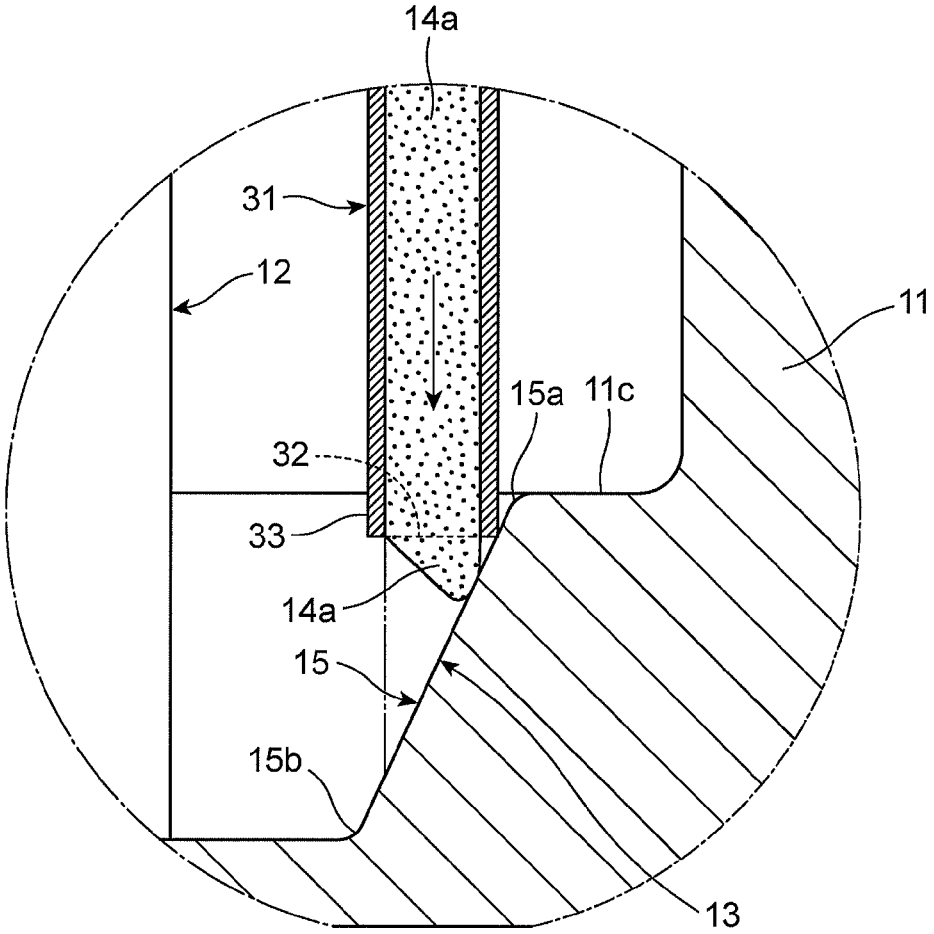
FIG. 8 is a partially enlarged cross-sectional view of the electric connector illustrated in FIG. 5 into which a resin starts being poured through a dispenser.

As illustrated in FIG. 8, when the uncured potting resin 14*a* is discharged through the discharge port 32 of the discharge tube 31 of the dispenser 30, a portion located nearer to the inner sidewall 15 is first adhered to the inner sidewall 15. Due to a viscosity of the uncured potting resin 14*a* (3 to 10 Pa·s), a portion of the uncured potting resin 14*a* located away from the inner sidewall 15 is pulled up towards the upper edge 15*a* of the inner sidewall 15, and hence, does not make contact with an area of the inner sidewall 15 near the lower edge 15*b*.

Figure 9:
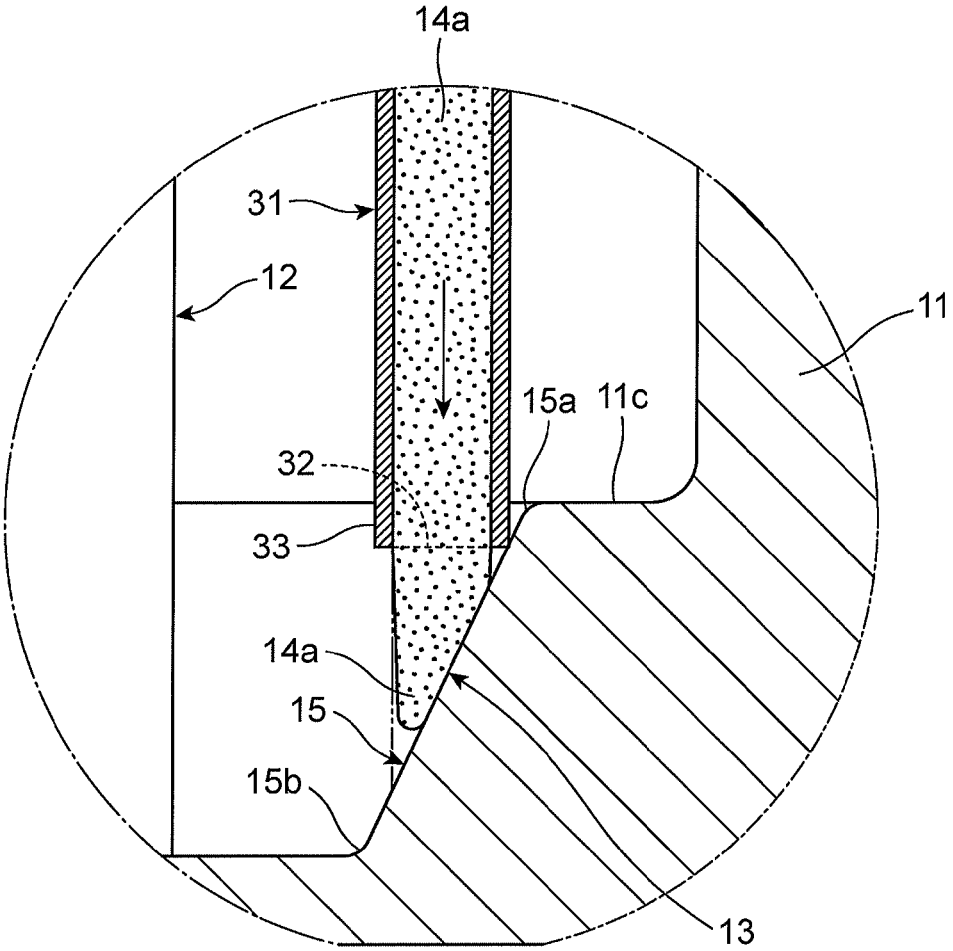
FIG. 9 is a partially enlarged cross-sectional view of the electric connector illustrated in FIG. 5 into which a resin is being poured through a dispenser.

When the uncured potting resin 14*a* is further poured into the recess 13, as illustrated in FIG. 9, the uncured potting resin 14*a* flows downwardly along the inner sidewall 15, and arrives at an area of the inner sidewall 15 near the lower edge 15*b*.

It is possible to pour the uncured potting resin 14*a* into the recess 31 in a uniform volume by horizontally moving the dispenser 30 during the uncured potting resin 14*a* is being poured into the recess 13. It is also possible to temporarily stop pouring the uncured potting resin 14*a* into the recess 13, upwardly move the dispenser 30, moving the dispenser 30 to another location of the inner sidewall 15, insert the dispenser 30 at the top end portion 33 into the recess 13, and again pour the uncured potting resin 14*a* into the recess 13 with the dispenser 30 being moved horizontally along the inner sidewall 15.

A position at which the dispenser 30 is inserted into the recess 13 may be arbitrarily selected in accordance with a shape of the recess 13.

As illustrated in FIG. 7, the uncured potting resin 14*a* is poured into the recess 13 towards the inclining inner sidewall 15 through the discharge port 32 of the discharge tube 31 of the dispenser 30. After making contact with a surface of the inner sidewall 15, the uncured potting resin 14*a* smoothly downwardly flows by virtue of the descending inclination of the inner sidewall 15 without rebounding and dispersing to thereby fill the recess 13 therewith. Thus, it is possible to avoid the generation of bubbles in the uncured potting resin 14*a* while the recess 13 is being filled with the uncured potting resin 14*a*, ensuring that the cured potting resin 14 presents superior sealing performance.

As mentioned earlier, the inclination angle of the inner sidewall 15 is set to be 25 degrees in the electric connector 10 in accordance with the first embodiment. This ensures it possible to cause the uncured potting resin 14*a* which will be cured to the cured potting resin 14, to smoothly flow along the inclining inner sidewall 15, and resultingly, it is possible to avoid the generation of bubbles in the uncured potting resin 14*a* while the recess 13 is being filled with the uncured potting resin 14*a*.

Figure 6:
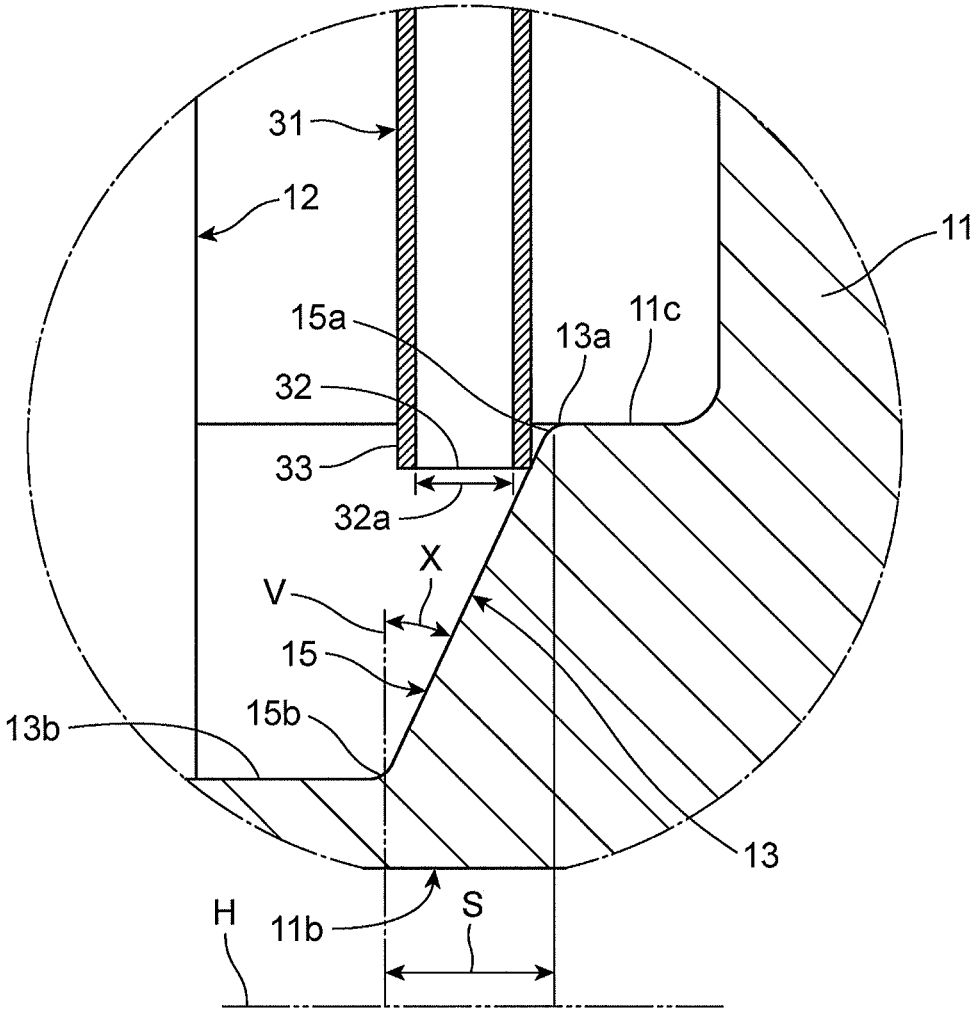
FIG. 6 is an enlarged view of an area indicated with an arrow D shown in FIG. 5.

Furthermore, as illustrated in FIG. 6, the horizontal distance S between the upper edge 15*a* and the lower edge 15*b* of the inner sidewall 15 is set greater than the diameter 32*a* of the discharge port 32. Consequently, as illustrated in FIG. 7, the uncured potting resin 14*a* vertically falling from the discharge port 32 to the inner sidewall 15 is able to make contact at entirety thereof with the inner sidewall 15 and smoothly flow on the inner sidewall 15, ensuring that the generation of bubbles in the uncured potting resin 14*a* is effectively avoidable while the recess 13 is being filled with the uncured potting resin 14*a*.

After the recess 13 was completely filled with the uncured potting resin 14*a*, the dispenser 30 is moved away from the housing 11, and then, the uncured potting resin 14*a* filling the recess 13 therewith is cured. Thus, as illustrated in FIGS. 2 and 3, the recess 13 is filled with the cured or solidified potting resin 14. Since the cured potting resin 14 scarcely involves bubbles therein, the cured potting resin 14 presents superior sealing performance.

The structure of the above-mentioned electric connector 10 is just an example of the electric connector in accordance with the present invention. Alternatives, modifications and equivalents may be applied to the electric connector 10.

Figure 10:
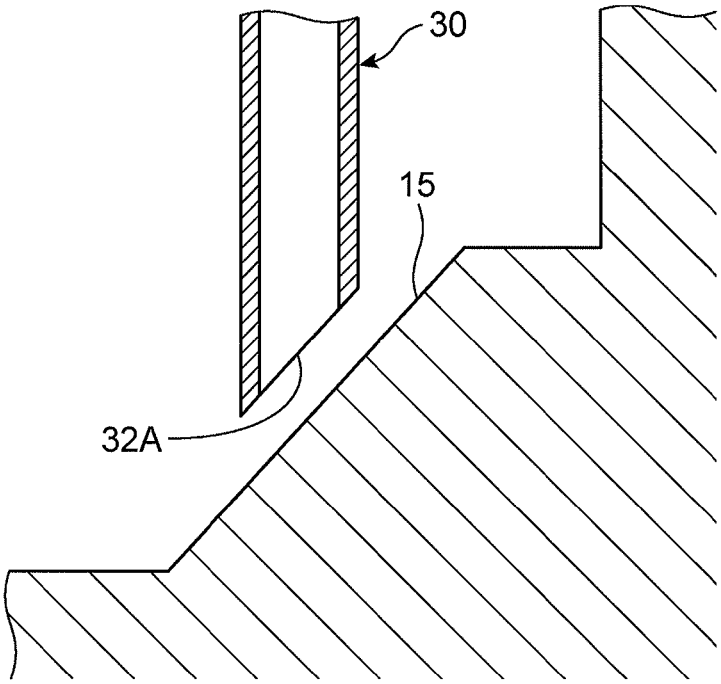
FIG. 10 is a partially enlarged cross-sectional view of a second-type dispenser.

FIG. 10 illustrates a second type of the dispenser 30. The illustrated dispenser 30 is designed to have a discharge port 32A inclining at the same degree as that of the inner sidewall 15. That is, the discharge port 32A is designed to be inclined by 25 degrees.

By designing the dispenser 30 to have a discharge port 32A inclining at the same degree as that of the inner sidewall 15, a gap between the discharge port 32A and the inner sidewall 15 is kept constant, ensuring that the uncured potting resin 14*a* smoothly flows down onto the inner sidewall 15 through the discharge port 32A of the dispenser 30.

Figure 11:
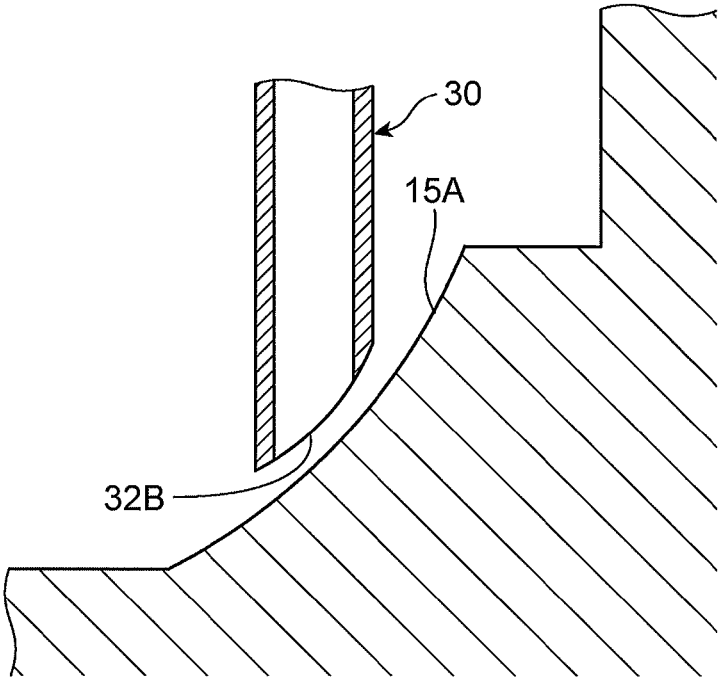
FIG. 11 is a partially enlarged cross-sectional view of a third-type dispenser.
Figure 12:
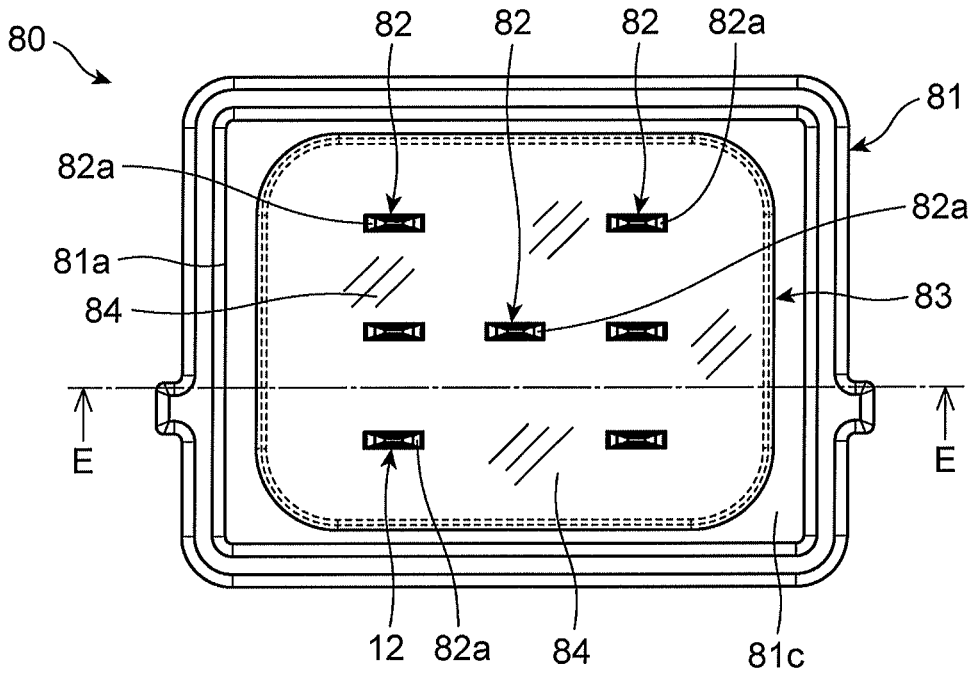
FIG. 12 is a plan view of a conventional electric connector.
Figure 13:
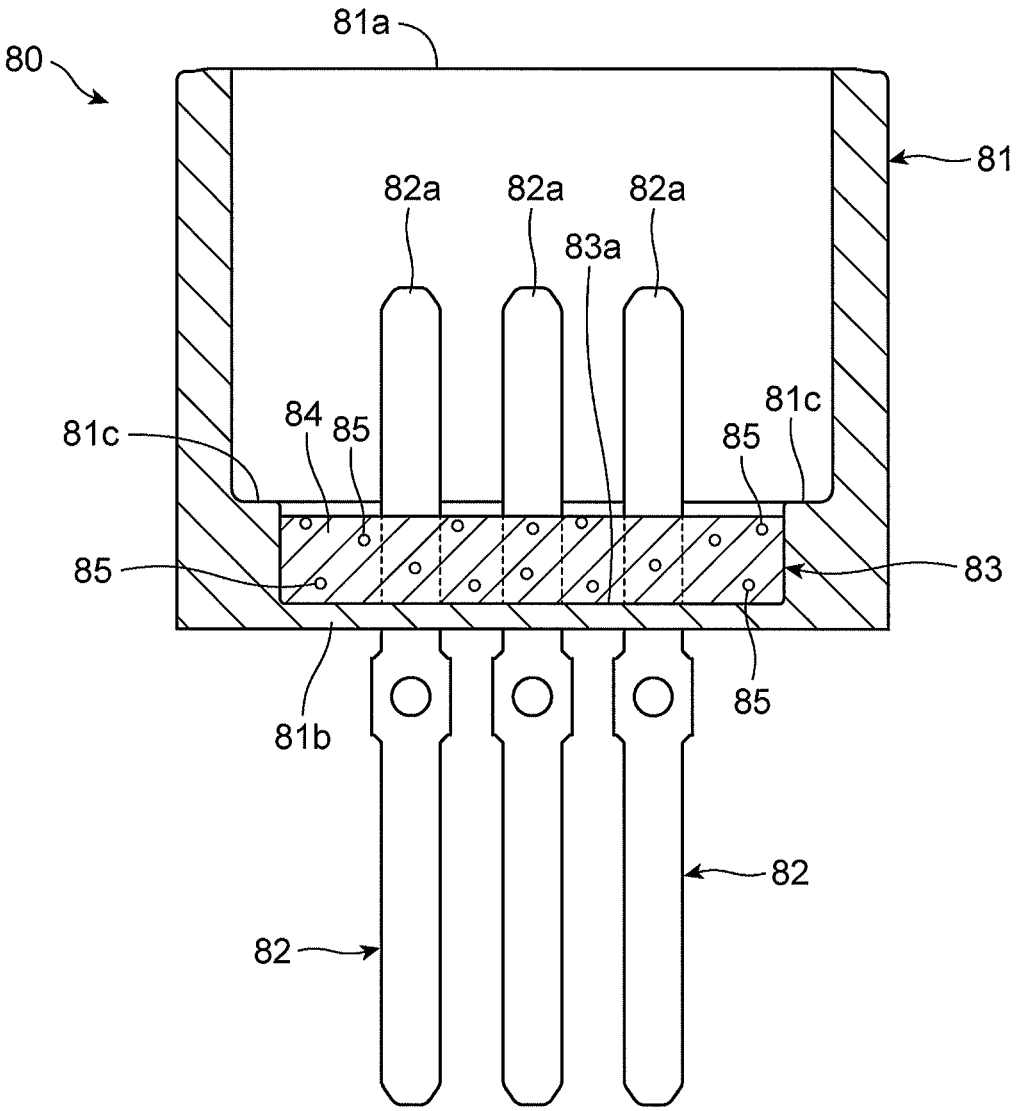
FIG. 13 is a cross-sectional view taken along the line E-E shown in FIG. 12.
Figure 14:
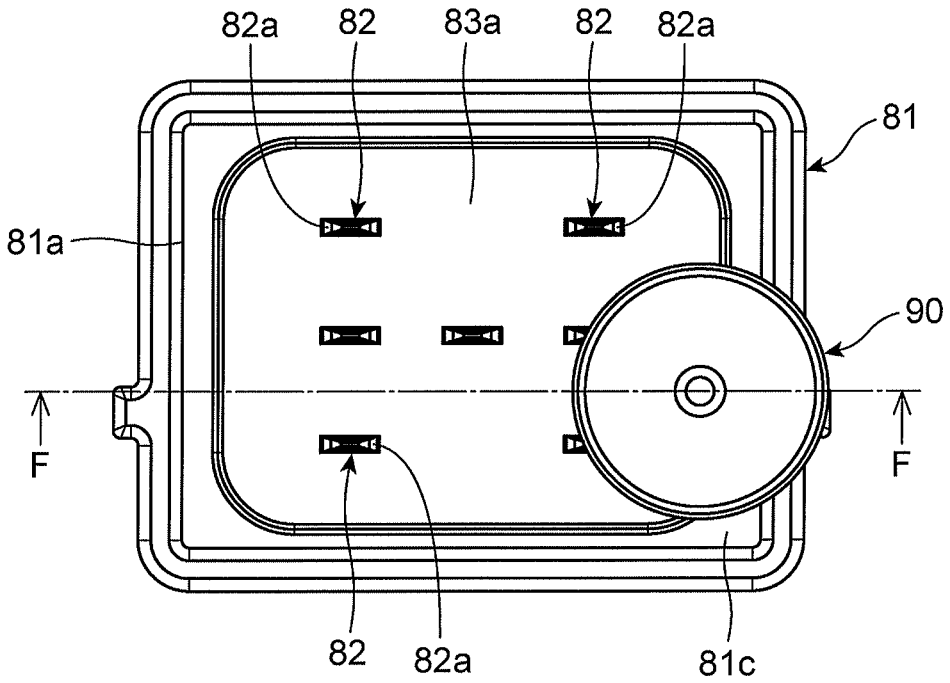
FIG. 14 is a plan view of the electric connector illustrated in FIG. 13 together with a dispenser used for pouring a resin into the electric connector.
Figure 15:
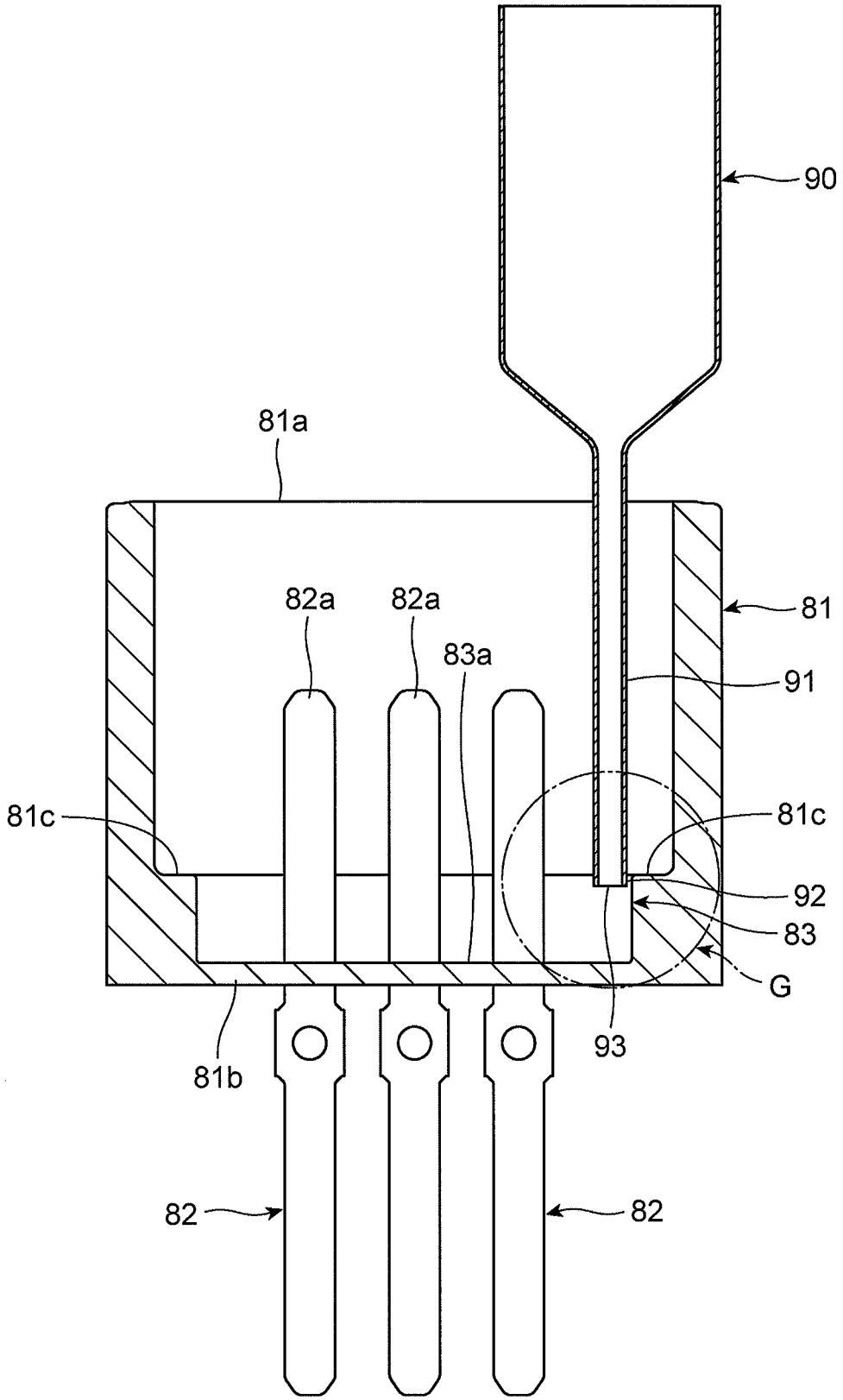
FIG. 15 is a cross-sectional view taken along the line F-F shown in FIG. 14.
Figure 16:
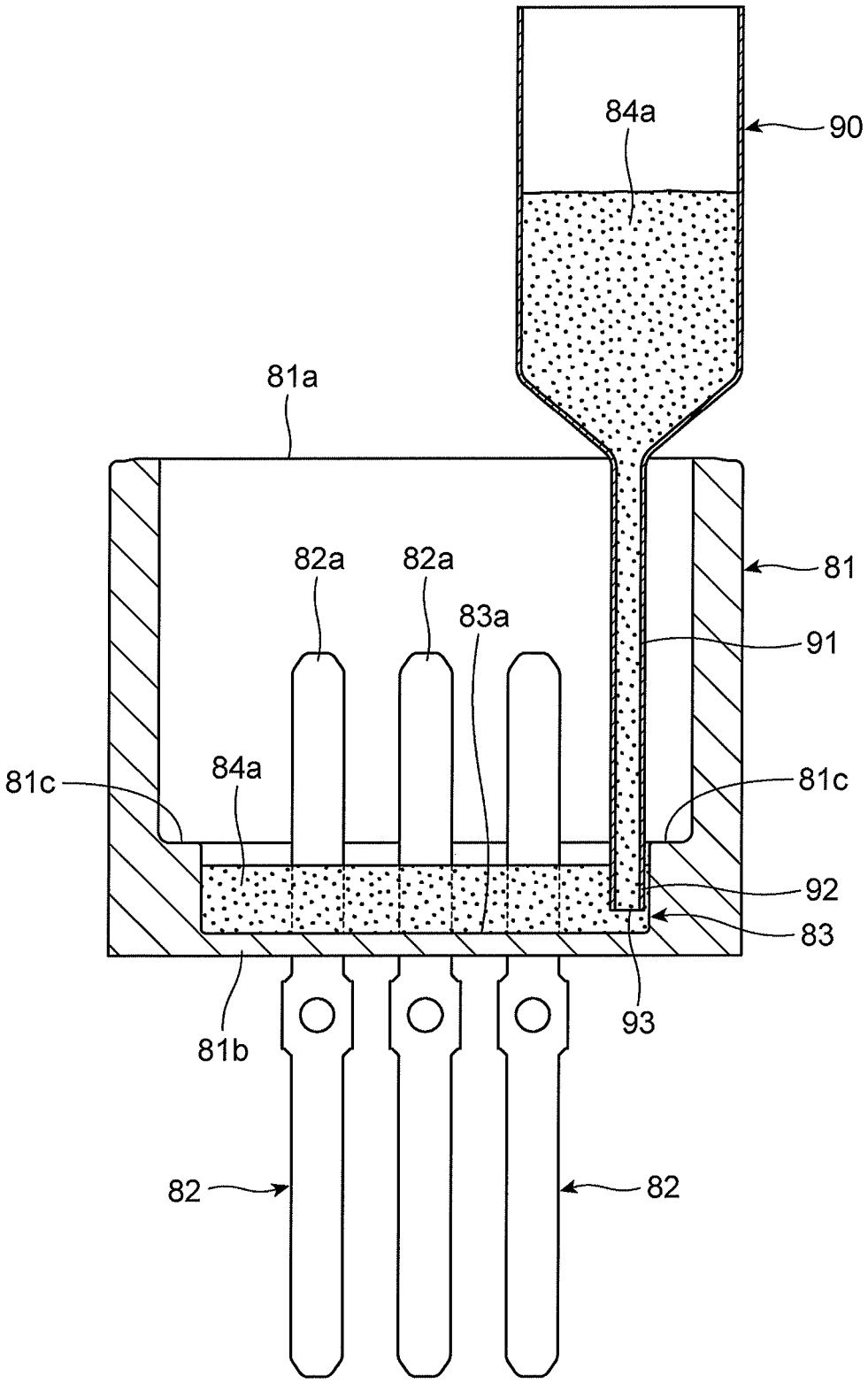
FIG. 16 is an enlarged cross-sectional view of the electric connector illustrated in FIG. 14 into which a resin is poured through a dispenser.
Figure 17:
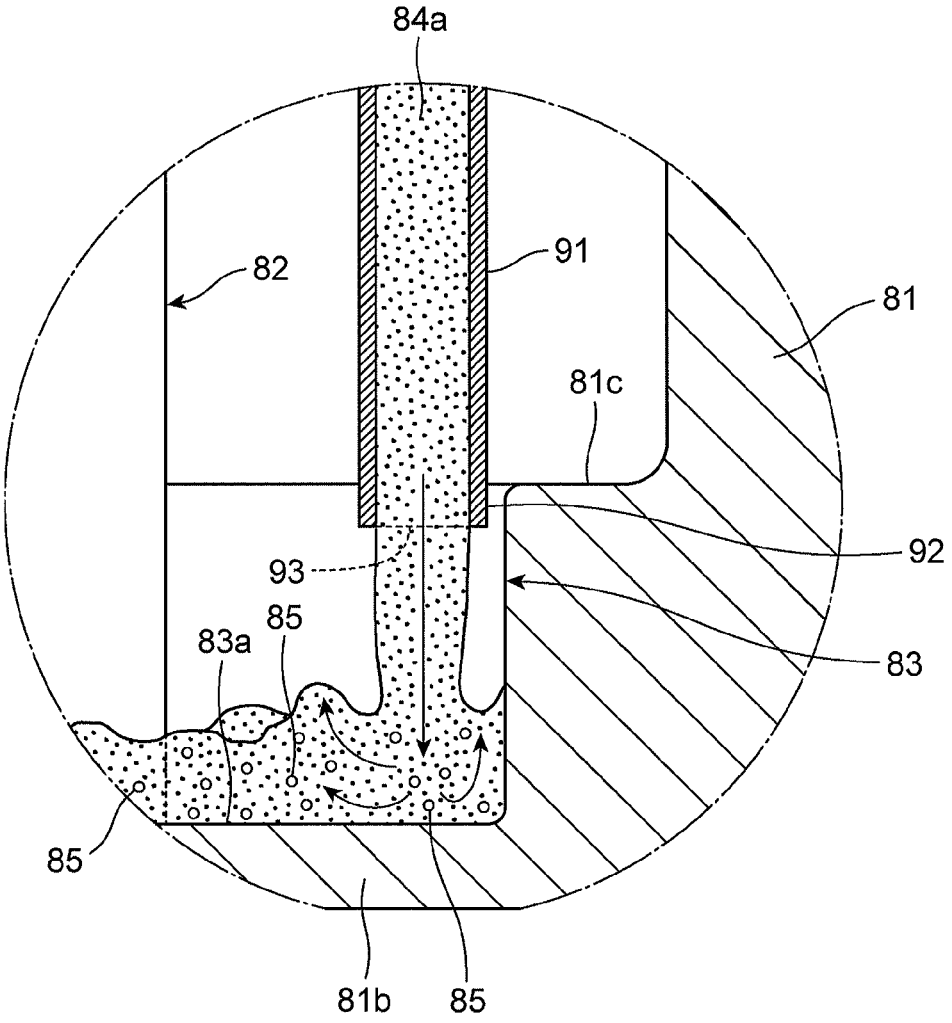
FIG. 17 is an enlarged view illustrating that a resin is being poured into a recess in an area indicated with an arrow G shown in FIG. 15.
Figure 18:
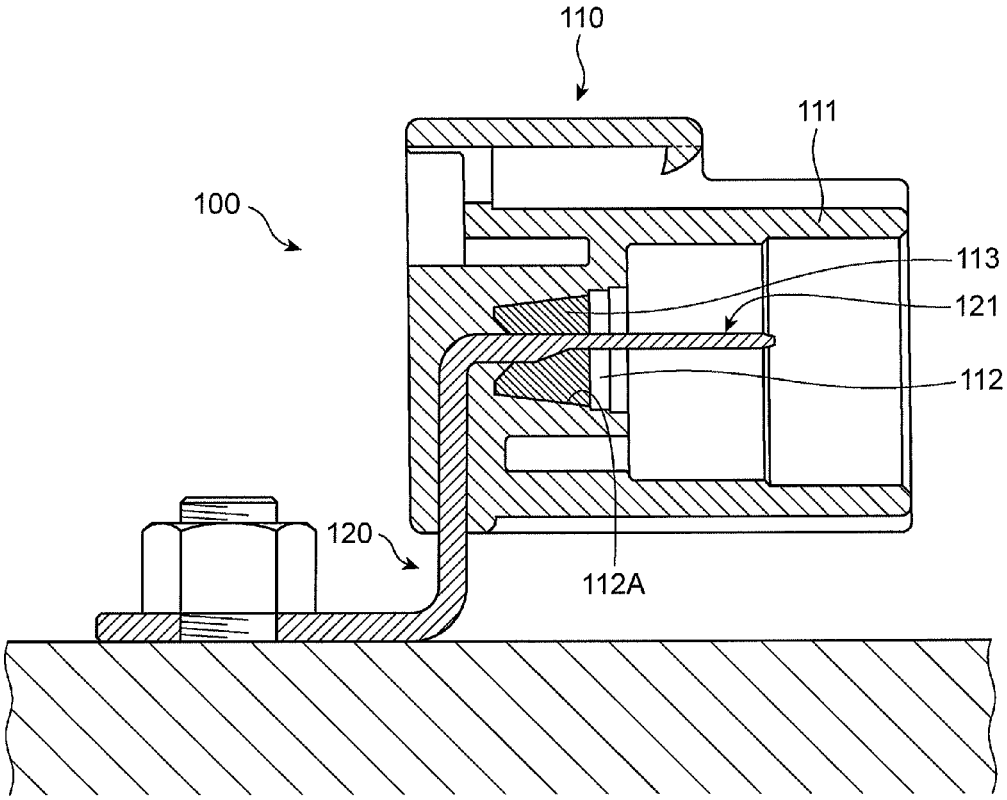
FIG. 18 is a cross-sectional view of another conventional electric connector.

The inner sidewall 15 in the first embodiment is designed flat. As an alternative, as illustrated in FIG. 11, the inner sidewall 15 may be replaced with an arcuate inner sidewall 15A downwardly projecting, in which case, the dispenser 30 is preferably designed to include a discharge port 32B having the same curvature as that of the arcuate inner sidewall 15A, ensuring that the uncured potting resin 14*a* smoothly flows down onto the inner sidewall 15A through the discharge port 32B of the dispenser 30.

INDUSTRIAL APPLICABILITY

The electric connector in accordance with the present invention is able to be used broadly in various fields such as an automobile industry and electric/electronic device industries, as a part of electrical wires equipped in an automobile or as a part of various electronic/electric devices.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-125488 filed on Jun. 14, 2013 including specification, claims, drawings and summary is incorporated herein by reference in its entirety.

What is claimed is:

1. An electric connector comprising:

a housing having an opening and a bottom, said housing being formed at said bottom with a recess;

at least one terminal inserted into said housing through a bottom of said recess such that a top of said at least one terminal is located in said housing; and a cured resin filled in said recess, said recess having an inclining inner sidewall.

2. The electric connector as set forth in claim 1, wherein said inner sidewall inclines by 25 to 50 degrees both inclusive.

3. The electric connector as set forth in claim 1, wherein said inner sidewall downwardly projects in an arcuate form.

4. The electric connector as set forth in claim 1, wherein a horizontal length of said inner sidewall is greater than a diameter of a discharge port of a dispenser by which an uncured resin is poured into said recess.

5. The electric connector as set forth in claim 2, wherein a horizontal length of said inner sidewall is greater than a diameter of a discharge port of a dispenser by which an uncured resin is poured into said recess.

6. The electric connector as set forth in claim 3, wherein a horizontal length of said inner sidewall is greater than a diameter of a discharge port of a dispenser by which an uncured resin is poured into said recess.

7. A method of fabricating an electric connector, comprising:

preparing a housing used for an electric connector, said housing having an opening and a bottom, said housing being formed at said bottom with a recess, and further formed at a bottom of said recess with at least one through-hole through which a terminal is inserted into said housing, said recess having an inclining inner sidewall;

inserting a terminal through said through-hole such that a top of said terminal is located in said housing;

locating a discharge port of a dispenser above said inner sidewall, said discharge port having a diameter smaller than a horizontal length of said inclining inner sidewall;

discharging an uncured resin onto said inclining inner sidewall through said discharge port to fill said recess with said uncured resin; and curing said uncured resin.

8. The method as set forth in claim 7, further comprising horizontally moving said dispenser along said inclining inner sidewall.

* * * * *